US005722123A

United States Patent [19]

Davignon et al.

[11] Patent Number: 5,722,123

[45] Date of Patent: Mar. 3, 1998

[54] CABLE TIE

[75] Inventors: Paul A. Davignon, Uxbridge, Mass.; Richard M. Bastien, Cumberland, R.I.; Francis L. Cormier, Jr., Dracut, Mass.

[73] Assignee: Avery Dennison Corporation, Pasadena, Calif.

[21] Appl. No.: 723,605

[22] Filed: Oct. 1, 1996

[51] Int. Cl.[6] ..... B65D 63/00

[52] U.S. Cl. ..... 24/16 PB; 24/17 AP; 24/30.5 P

[58] Field of Search ..... 24/16 PB, 17 AP, 24/30.5 P; 248/74.3

[56] References Cited

U.S. PATENT DOCUMENTS

| | | | |
|---|---|---|---|
| 2,936,980 | 5/1960 | Rapata | 24/17 AP |
| 2,979,794 | 4/1961 | DeBartolo | 24/16 PB |
| 3,127,648 | 4/1964 | Emery | 24/16 PB |
| 3,224,056 | 12/1965 | Joffe | 24/16 PB |
| 3,368,247 | 2/1968 | Orban . | |
| 3,484,905 | 12/1969 | Eberhardt . | |
| 3,965,538 | 6/1976 | Caveney et al. . | |
| 3,973,293 | 8/1976 | Noorily . | |
| 4,009,509 | 3/1977 | McCormick . | |
| 4,502,187 | 3/1985 | Kitagawa | 24/30.5 P |
| 4,658,478 | 4/1987 | Paradis . | |

*Primary Examiner*—Victor N. Sakran
*Attorney, Agent, or Firm*—Kriegsman & Kriegsman

[57] ABSTRACT

A one piece cable tie for forming a plurality of objects such as cables into a bundle. The cable tie includes in one embodiment an elongated flexible strap having a top planar surface, a bottom planar surface, a first end and a second end. The strap further includes a plurality of raised cross-members spaced along its length, each cross-member being in the shape of a ratchet tooth. A locking head is integrally formed to the first end of the strap. The locking head has a top surface and a bottom surface and includes a strap accepting channel having an inner end wall and an outer end wall. The outer end wall is shaped to include an angled locking face for engaging with one of the raised cross-members. In use, after the second end of the strap has been inserted through the strap accepting channel and drawn tight around a bundle and the insertion force is thereafter relaxed, the stored pressure of the bundle by virtue of its configuration pivots the strap causing one of the raised cross-members to abut against the angled locking face to lock the strap in place.

13 Claims, 3 Drawing Sheets

CABLE TIE

BACKGROUND OF THE INVENTION

The present invention relates to cable ties.

Cable ties, also known as harnessing devices, are well known in the art and are commonly used for bundling objects.

In U.S. Pat. No. 4,658,478 to J. R. Paradis there is disclosed a harnessing device for the bundling of objects which includes a locking head and a strap with teeth that are controlled by stretching. The locking head contains a pawl or tang that engages the teeth of the strap by wedging. A wedging tooth is desirably on the locking tang as well, and a further tooth to promote locking is desirably included in the locking head. The strap is advantageously molded of stretch reorientable material which is subsequently stretched to control the profile of the teeth which are engaged by the locking tang and head.

In U.S. Pat. No. 4,009,509 to M. McCormick there is disclosed a cable tie which is moulded in one piece and which comprises an elongate flexible strap provided with ratchet serrations on one side and a head at one end of the strap, the head having an aperture provided with a pivoted pawl having teeth which engage the ratchet serrations of the strap when the free end of the strap is passed through the aperture. The pawl teeth have their crests in a common plane, in the moulded condition of the tie, which lies substantially perpendicular to the plane of the strap. The aperture is formed opposite the pawl with an abutment surface which is inclined to the common plane of the pawl teeth so that the pawl tooth furthest from the pawl pivot is closest to the abutment surface.

In U.S. Pat. No. 3,973,293 to P. Noorily there is disclosed a preferably unitary molded bundling strap having an enlarged head portion which comprises, in one embodiment, a pair of independently supported, spaced, parallel barb means depending within an obliquely oriented opening extending through the head portion, the barb means being oriented in such manner as to be subjected to a non-deflecting force directed essentially along the longitudinal axis of the respective barb means upon coacting locking engagement with the selectively inclined mating surfaces of a plurality of transverse teeth located along one surface of a flat, flexible strap-like member extending from the head portion.

In U.S. Pat. No. 3,965,538 to J. E. Caveney et al there is disclosed an integral one-piece cable tie including an elongated flexible strap having a row of teeth thereon, a frame integral with one end of the strap and having an abutment wall and an end wall and an entry surface and an exit surface and a strap-receiving opening therethrough, a ledge extending from the end wall, and a pawl pivotally mounted on and integral with the ledge within the opening and having a set of teeth shaped complementary to the row of teeth and defining with the end wall a strap-receiving throat inclined to the longitudinal axis of the strap as molded, the abutment wall having a plurality of strap-gripping projections thereon extending toward the pawl.

In U.S. Pat. No. 3,484,905 to R. Eberhardt there is disclosed a flexible tie for a bundle of electrical conductors or the like. The tie is molded in one piece of a resilient, yet generally shape-retaining plastic composition. At one end of the tie is a head having an aperture to admit a strap part extending from the head in order that the device may be looped around the bundle. Within the aperture is a resilient finger having an active edge to engage one of a plurality of teeth on the strap in order that the device may be locked in position around the bundle. The construction is such that more reliable engagement is obtained without the use of metal inserts or other expedients and by means which allows molding of the device in one piece in a simple, inexpensive mold.

In U.S. Pat. No. 3,368,247 to G. A. Orban there is disclosed a cable tie which includes an elongated tongue and a substantially rectangular open frame at one end of the tongue. This frame has pivoted therein a relatively thick pawl defining, with the frame, a curved entry throat for insertion of the free end of the cable tie into the frame. The exit end of the pawl is disposed substantially inwardly of the exit surface of the frame, and the pawl and a surface of the tongue are formed with ratchet means interengageable upon insertion of the tongue through the entry throat to prevent withdrawal of the tongue through the passage through the rectangular frame. The recessing of the exit or free end of the pawl substantially inwardly of the exit surface of the open frame allows the projecting portion of the drawn tongue to be nipped off to provide a cut edge which is disposed inwardly of the exit end of the frame.

SUMMARY OF THE INVENTION

It is an object of this invention to provide a new and improved cable tie.

It is another object of this invention to provide a one-piece cable tie.

It is yet another object of this invention to provide a cable tie as described above which provides for the secure bundling of objects.

It is still another object of this invention to provide a cable tie as described above which has a low profile.

It is another object of this invention to provide a cable tie as described above which can be tightened while in the pivoted position.

It is yet another object of this invention to provide a cable tie as described above which has a minimum number of parts, is simple in construction and is easy to use.

In one embodiment of the present invention, there is provided a one piece cable tie for forming a plurality of objects such as cables into a bundle, said cable tie comprising an elongated flexible strap having a top planar surface, a bottom planar surface, a first end and a second end, said strap having a plurality of raised cross-members spaced along its length, said cross-members being in the form of ratchet teeth, each ratchet tooth having a front surface and a rear surface, and a locking head integrally formed to the first end of said strap, said locking head having a top surface and a bottom surface and including a strap accepting channel having an inner end wall and an outer end wall, one of said end walls being shaped to include an angled locking face for engaging with the rear surface of one of said raised cross-members, whereby after the second end of said strap has been inserted through said strap accepting channel and drawn tight around a bundle and the insertion force is thereafter relaxed, the stored pressure of the bundle by virtue of its configuration pivots said strap causing the rear surface of one of the raised cross-members to abut against the angled locking face to lock the strap in place.

In another embodiment of the present invention, there is provided a one piece cable tie for forming a plurality of objects such as cables into a bundle, said cable tie comprising an elongated flexible strap having a top planar surface, a bottom planar surface, a first end and a second end, said strap further including a plurality of raised cross-members spaced along its length, each cross-member being in the form of a ratchet tooth having a rear surface and a front surface, the rear surface of one ratchet tooth and the front surface of the ratchet tooth behind it defining a corner, and a locking head integrally formed to the first end of said strap, said locking head having a top surface and a bottom surface and including a strap accepting channel having an inner end wall and an outer end wall, one of said end walls being shaped to include a rounded locking tip for engaging with one of said corners, whereby after the second end of said strap has been inserted through said strap accepting channel and drawn tight around a bundle and the insertion force is thereafter relaxed, the stored pressure of the bundle by virtue of its configuration pivots said strap causing said rounded locking tip to engage with one of said corners to lock the strap in place. Each cross-member includes a relatively flexible top portion and a relatively inflexible bottom portion, said flexible top portion enabling the second end of said strap to be advanced through the strap accepting channel while said strap is pivoted in the locked position.

Various other features and advantages will appear from the description to follow. In the description, reference is made to the accompanying drawings which form a part thereof, and in which is shown by way of illustration, specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
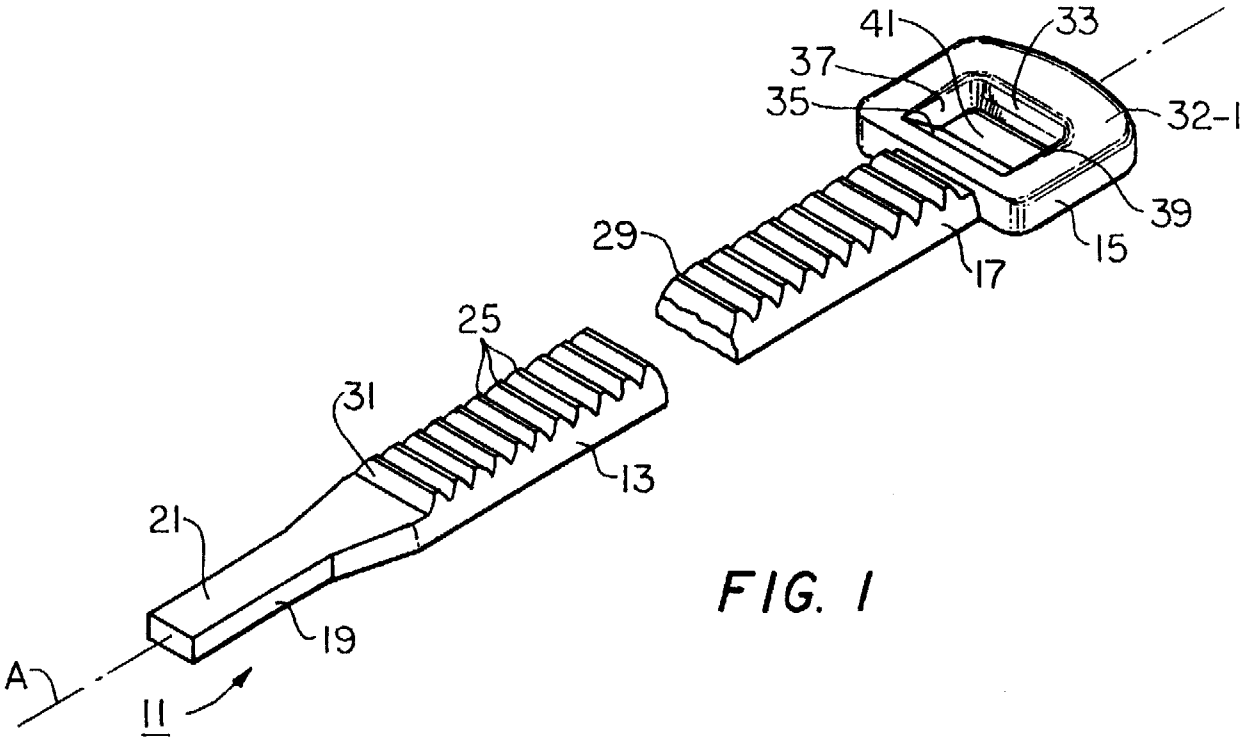
FIG. 1 is a perspective view taken from the top of a first embodiment of a cable tie constructed according to the teachings of the present invention.
Figure 2:
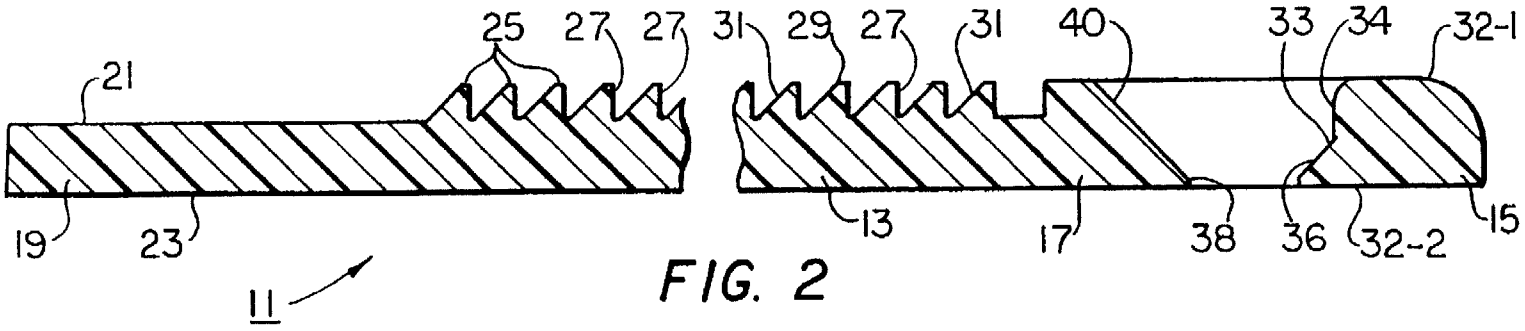
FIG. 2 is a side section view of the cable tie shown in FIG. 1.
Figure 3:
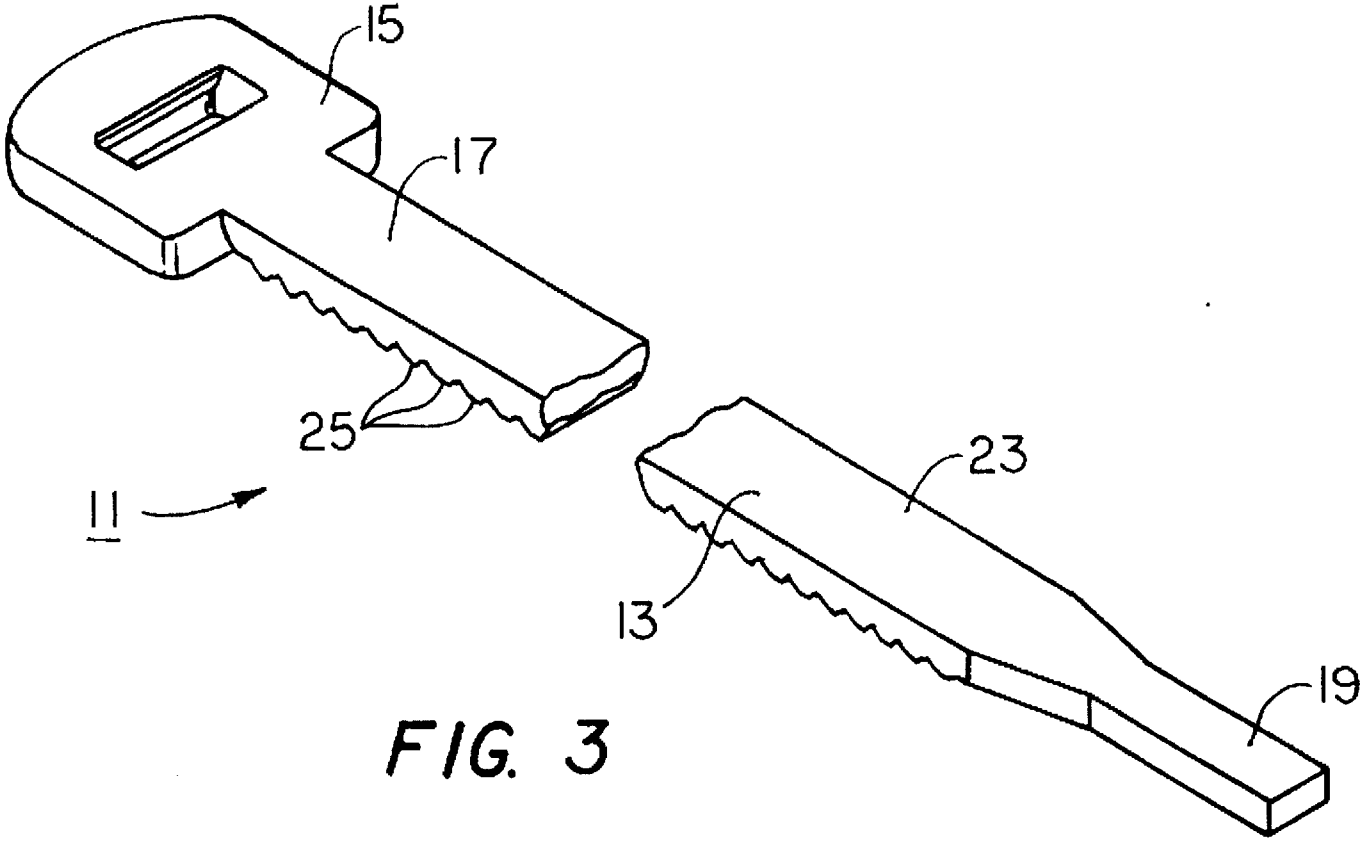
FIG. 3 is a perspective view taken from the bottom of the cable tie shown in FIG. 1.
Figure 4:
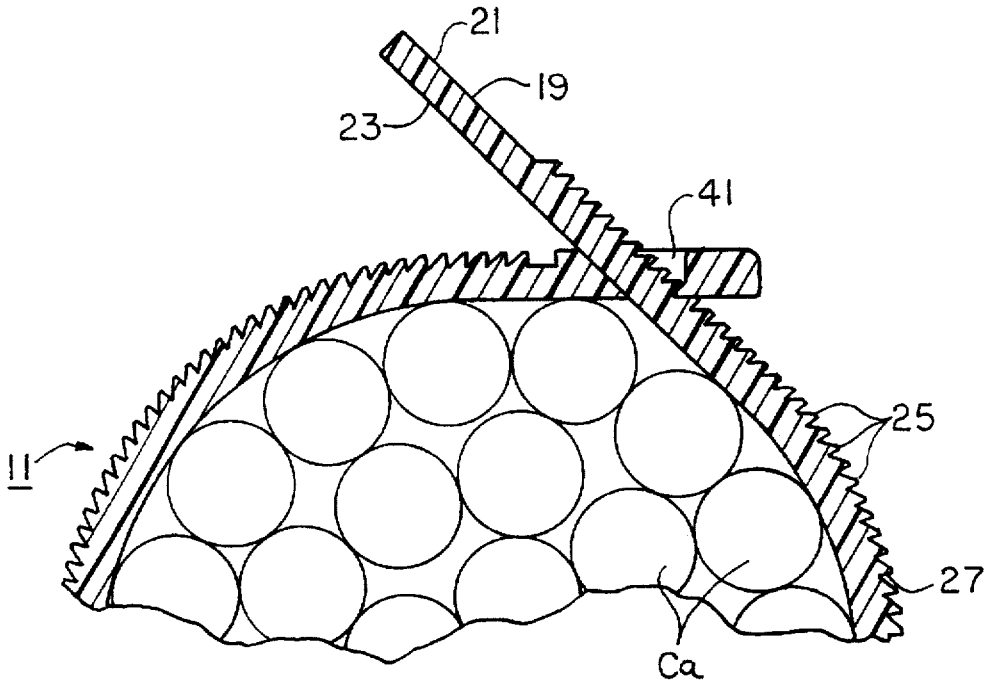
FIG. 4 is a side section view of the cable tie shown in FIG. 1, the tie being shown in the form of a loop wrapped around a bundle of cables.

Referring now to the drawings, there are shown in FIGS. 1–4 a first embodiment of a cable tie constructed according to the teachings of the present invention, the cable tie being identified by reference numeral 11. As shown in FIG. 4, cable tie 11 can be used to bundle together a plurality of cables C; however, it is to be understood that the invention is not exclusively limited to bundling cables, but rather may be used to bundle together other objects.

Cable tie 11 is a one piece tie comprising an elongated strap 13 and a locking head 15.

Elongated strap 13 is constructed of a flexible material such as plastic, nylon or a high modulus elastomer and includes a first end 17, a second end 19, a top planar surface 21 and a bottom planar surface 23.

Strap 13 further includes a plurality of raised cross-members 25 spaced along its length. Raised cross-members 25 extend transversely along strap 13 and protrude above top planar surface 21 of strap 13.

Each cross-member 25 is in the form of a ratchet shaped tooth and comprises a rear surface 27 normal to the longitudinal axis A of strap 13, a top surface 29 which is flat and parallel to top surface 21 and a front surface 31 which angles upwardly and rearwardly at an angle of about 45 degrees from the longitudinal axis A of strap 13.

Locking head 15 is integrally formed to first end 17 of elongated strap 13. Locking head 15 comprises a top surface 32-1, a bottom surface 32-2, an outer end wall 33, an inner end wall 35, a first sidewall 37 and a second sidewall 39 which together define a strap accepting channel 41 therebetween.

Outer end wall 33 includes a top portion 34 that extends down vertically from top surface 32-1 and a bottom portion 36 that is angled downward and inward at approximately 50 degrees and which serves as an angled locking face. Angled locking face 36 cooperates with rear surface 27 of one of teeth 25 to lock strap 13 in place as will hereinafter be explained.

Inner end wall 35 includes a bottom portion 38 that extends up vertically from bottom surface 32-2 and a top portion 40 that is angled downward and inward and which serves an angled resting face.

Tie 11 may be used to secure a plurality of cables C as a bundle in the following manner as shown in FIG. 4. Second end 19 of strap 13 is wrapped around cables C and is inserted through strap accepting channel 41 to form a loop. Second end 19 is further advanced through strap accepting channel 41 to reduce the size of the loop, drawing tie 11 tight around the bundle of cables C. As the insertion force of second end 19 is relaxed, the stored pressure of the bundle by virtue of its configuration pushes against bottom surface 23 causing strap 13 to pivot. As strap 13 pivots, rear surface 27 of one of raised cross-members 25 abuts against angled locking face 36 to lock tie 11 in place around the bundle. Locked in this position, a portion of bottom surface 23 will lie on top of angled resting face 40.

As can be seen in the Figures, tie 11 is a low profile tie in that top surface 32-1 of head 15 does not project above top flat surface 29 of cross-members 25 and bottom surface 32-2 of head 15 does not project below bottom surface 23 of strap 13. In fact, top surface 32-1 is coplanar with top flat surface 29 of cross-members 25 and bottom surface 32-2 is coplanar with bottom surface 23.

Figure 5:
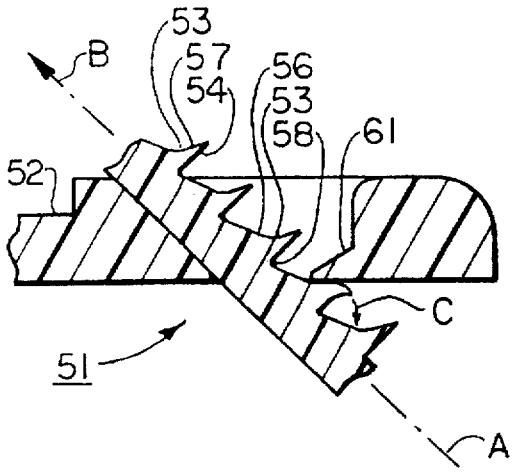
FIG. 5 is an enlarged, fragmentary section view of a second embodiment of a cable tie constructed according to the teachings of the present invention, with the strap inserted into the head and in one position.
Figure 6:
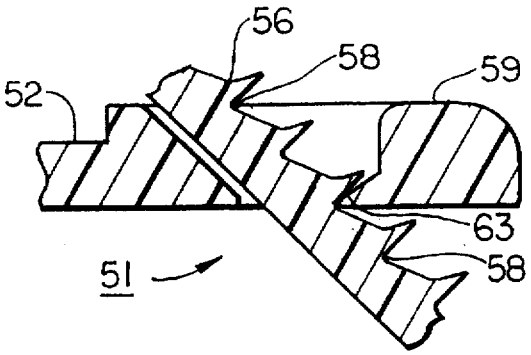
FIG. 6 is an enlarged, fragmentary section view of the cable tie shown in FIG. 5, with the strap inserted into the head and in another position.

FIGS. 5 and 6 show a second embodiment of a cable tie constructed according to the teachings of the present invention, the cable tie being identified by reference numeral 51. Cable tie 51 differs from cable tie 11 in that cable tie 51 includes a plurality of raised cross-members 53 which differ in construction from cross-members 25. Each cross-member 53 is in the form of a ratchet tooth having a rear surface 54 normal to the longitudinal axis A of strap 52 and a front surface 56 which angles upwardly and rearwardly relative to axis A. Front surface 56 and rear surface 54 meet in an elongated tip 57 which is flexible. The rear surface 54 of each tooth meets with the front surface 56 of the tooth behind it at a corner 58.

Cable tie 51 further differs from cable tie 11 in that cable tie 51 includes a locking head 59 having an outer end wall 61 which differs in construction from outer end wall 33. Outer end wall 61 is angled downward and inward to form a rounded locking tip 63 with bottom surface 65. Rounded locking tip 63 engages with a corner 58 to lock cable tie 51 in place around a bundle as will hereinafter be described.

In use, strap 52 is inserted through the strap accepting channel 64 in locking head 59 to form a loop around a bundle. As the insertion force of the second end of tie 51 is relaxed, the stored pressure of the bundle by virtue of its configuration causes tie 51 to pivot. As tie 51 pivots, rounded locking tip 63 engages with a corner 58 to lock tie 51 in place around the bundle.

As can be appreciated, because top portion 57 of each cross-member 53 is flexible, tie 51 can be further tightened around the cables while tie 51 is pivoted. Also, as shown in FIG. 5, when strap 52 is further advanced in direction B through strap accepting channel 64 in the pivoted position, top portion 57 of cross-member 53 flexes in direction C to enable cross-member 53 to advance past rounded locking tip 63. Referring to FIG. 6, once as the insertion force is relaxed, flexible top portion 57 is strong enough to guide rounded locking tip 63 down into a corner 58 to lock tie 51 in place around the bundle.

The embodiments shown in the present invention are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A one piece cable tie for forming a plurality of objects such as cables into a bundle, said cable tie comprising:

(a). an elongated flexible strap having a top planar surface, a bottom planar surface, a first end and a second end, said strap having a plurality of raised cross-members spaced along its length, and (b). a locking head integrally formed to the first end of said strap, said locking head having a top surface, a bottom surface and a strap accepting channel, the strap accepting channel being defined by a first sidewall, a second sidewall, an inner end wall and an outer end wall, the strap accepting channel extending through said locking head from the bottom surface of said locking head to the top surface of said locking head, one of said end walls being shaped to include a non-pivotable angled locking face which extends from the first sidewall to the second sidewall, the angled locking face being sized and shaped to engage one of said raised cross-members, (c). whereby after the second end of said strap has been inserted through said strap accepting channel and drawn tight around a bundle and the insertion force is thereafter relaxed, the stored pressure of the bundle by virtue of its configuration pivots said strap causing one of the raised cross-members to abut against the angled locking face to lock the strap in place.

2. A one piece cable tie for forming a plurality of objects such as cables into a bundle, said cable tie comprising:

(a). an elongated flexible strap having a top planar surface, a bottom planar surface, a first end and a second end, said strap further including a plurality of raised cross-members separated by corners, and (b). a locking head integrally formed to the first end of said strap, said locking head having a top surface, a bottom surface and a strap accepting channel, the strap accepting channel being defined by a first sidewall, a second sidewall, an inner end wall and an outer end wall, the strap accepting channel extending through said locking head from the bottom surface of said locking head to the top surface of said locking head, one of said end walls being shaped to include a non-pivotable locking tip which extends from the first sidewall to the second sidewall, said locking tip being sized and shaped to engage one of said corners, (c). whereby after the second end of said strap has been inserted through said strap accepting channel and drawn tight around a bundle and the insertion force is thereafter relaxed, the stored pressure of the bundle by virtue of its configuration pivots said strap causing said locking tip to engage with one of said corners to lock the strap in place.

3. The cable tie as claimed in claim 2 wherein each cross-member includes a flexible top portion and an inflexible bottom portion, said flexible top portion enabling the second end of said strap to be advanced through the strap accepting channel while said strap is in the pivoted position.

4. The cable tie as claimed in claim 3 wherein each corner is formed directly behind its associated cross-member at the junction of the top planar surface of said strap and the bottom portion of each cross-member.

5. A one piece cable tie for forming a plurality of objects such as cables into a bundle, said cable tie comprising:

(a). an elongated flexible strap having a top planar surface, a bottom planar surface, a first end and a second end, said strap having a plurality of raised cross-members spaced along its length, and (b). a locking head integrally formed to the first end of said strap, said locking head having a top surface and a bottom surface and including a strap accepting channel having an inner end wall and an outer end wall, the outer end wall of the said strap receiving channel being shaped to include an angled locking face for engaging with one of said raised cross-members, said angled locking face sloping downwardly and inwardly, (c). whereby after the second end of said strap has been inserted through said strap accepting channel and drawn tight around a bundle and the insertion force is thereafter relaxed, the stored pressure of the bundle by virtue of its configuration pivots said strap causing one of the raised cross-members to abut against the angled locking face to lock the strap in place.

6. The cable tie as claimed in claim 5 wherein the inner end wall of said strap receiving channel is shaped to include an angled resting face on which a portion of said strap rests when said strap is pivoted in the locked position.

7. The cable tie as claimed in claim 6 wherein the angled resting face slopes downwardly and inwardly.

8. The cable tie as claimed in claim 7 wherein said raised cross-members project up from the top planar surface of said strap.

9. The cable tie as claimed in claim 8 wherein said raised cross-members are in the shape of teeth.

10. The cable tie as claimed in claim 9 wherein the teeth are ratchet shaped.

11. A one piece cable tie for forming a plurality of objects such as cables into a bundle, said cable tie comprising:

(a). an elongated flexible strap having a top planar surface, a bottom planar surface, a first end and a second end, said strap further including a plurality of raised cross-members separated by corners, each cross-member including a flexible top portion and an inflexible bottom portion, each corner being formed directly behind its associated cross-member at the junction of the top planar surface of said strap and the bottom portion of each cross-member, and (b). a locking head integrally formed to the first end of said strap, said locking head having a top surface and a bottom surface and including a strap accepting channel having an inner end wall and an outer end wall, one of said end walls being shaped to include a locking tip for engaging with one of said corners, said rounded locking tip being on the outer end wall of said strap receiving channel, (c). whereby after the second end of said strap has been inserted through said strap accepting channel and drawn tight around a bundle and the insertion force is thereafter relaxed, the stored pressure of the bundle by virtue of its configuration pivots said strap causing said locking tip to engage with one of said corners to lock the strap in place, said flexible top portion enabling the second end of said strap to be advanced through the strap accepting channel while said strap is in the pivoted position.

12. The cable tie as claimed in claim 11 wherein the inner end wall of said strap receiving channel includes an angled resting face on which a portion of said strap rests when said strap is pivoted in the locked position.

13. The cable tie as claimed in claim 12 wherein the angled resting face slopes downwardly and inwardly.

* * * * *